US009782774B2

(12) United States Patent
Zamir et al.

(10) Patent No.: US 9,782,774 B2
(45) Date of Patent: Oct. 10, 2017

(54) MICROFLUIDIC METERING OF FLUIDS

(71) Applicant: Daktari Diagnostics, Inc., Cambridge, MA (US)

(72) Inventors: Lee Zamir, Cambridge, MA (US); Aaron Oppenheimer, Cambridge, MA (US); Lutz Weber, Zweibruecken (DE)

(73) Assignee: Daktari Diagnostics, Inc., Cambridge, MA (US)

( * ) Notice: Subject to any disclaimer, the term of this patent is extended or adjusted under 35 U.S.C. 154(b) by 341 days.

(21) Appl. No.: 14/463,865

(22) Filed: Aug. 20, 2014

(65) Prior Publication Data

US 2015/0056717 A1 Feb. 26, 2015

Related U.S. Application Data

(60) Provisional application No. 61/869,373, filed on Aug. 23, 2013.

(51) Int. Cl.
*B01L 3/00* (2006.01)

(52) U.S. Cl.
CPC ... *B01L 3/502738* (2013.01); *B01L 3/502723* (2013.01); *B01L 3/502776* (2013.01); *B01L 2200/0605* (2013.01); *B01L 2200/0647* (2013.01); *B01L 2200/0684* (2013.01); *B01L 2200/10* (2013.01); *B01L 2300/0816* (2013.01); *B01L 2300/0819* (2013.01); *B01L 2300/0864* (2013.01); *B01L 2300/0867* (2013.01); *B01L 2400/0406* (2013.01);
(Continued)

(58) Field of Classification Search
CPC ..... B01L 3/502738; B01L 3/502723; B01L 3/502776; B01L 2300/0864; B01L 2300/0867; B01L 2300/0816; B01L 2300/0819; B01L 2200/0605; B01L 2200/0684; B01L 2200/0647; B01L 2200/10; B01L 2400/0406; B01L 2400/0688; B01L 2400/0487; Y10T 436/2575
See application file for complete search history.

(56) References Cited

U.S. PATENT DOCUMENTS

2009/0191643 A1* 7/2009 Boehm ..... B01L 3/5023 436/164
2012/0178182 A1 7/2012 Kim et al.

FOREIGN PATENT DOCUMENTS

CN 1524619 9/2004
CN 101754812 6/2010
(Continued)

OTHER PUBLICATIONS

International Search Report in International Application No. PCT/US2014/051838, mailed on Nov. 18, 2014, 11 pages.
(Continued)

*Primary Examiner* — Christopher A Hixson
(74) *Attorney, Agent, or Firm* — Fish & Richardson P.C.

(57) ABSTRACT

This document provides methods and devices for metering fluids. In some cases, the methods and devices include intersecting channels that include capillary-stop geometries at each intersection point that guides the fluids on a desired path, which is controlled by the opening and closing of valves. For example, a metering channel can intersect a loading channel and intersect an outflow channel and a metering portion can be defined by the geometry of the metering channel between the intersection points.

16 Claims, 6 Drawing Sheets

(52) U.S. Cl.
CPC ..... *B01L 2400/0487* (2013.01); *B01L 2400/0688* (2013.01); *Y10T 436/2575* (2015.01)

(56) References Cited

FOREIGN PATENT DOCUMENTS

| | | |
|---|---|---|
| CN | 102631956 | 8/2012 |
| WO | 2002/083310 | 10/2002 |
| WO | 2005/085855 | 9/2005 |

OTHER PUBLICATIONS

International Preliminary Report on Patentability for PCT/US2014/051838, mailed Mar. 3, 2016, 9 pages.
Chinese Office Action in Chinese Application No. 201480052363.8, dated Feb. 8, 2017, 21 pages (with English translation).

* cited by examiner

MICROFLUIDIC METERING OF FLUIDS

CROSS-REFERENCE TO RELATED APPLICATIONS

This application claims benefit of priority from U.S. Provisional Application Ser. No. 61/869,373, filed on Aug. 23, 2013.

TECHNICAL FIELD

This document relates to methods and materials involved in metering fluids. For example, this document provides microfluidic channels configured to precisely meter small volumes of samples and/or reagents, which can be used in microfluidic systems for diagnosing one or more disease conditions.

BACKGROUND

In parts of the world, diseases such as HIV infection (and various stages of the disease), syphilis infection, malaria infection, and anemia are common and debilitating to humans, particularly to pregnant women. For example, nearly 3.5 million pregnant women are HIV-infected, and nearly 700,000 babies contract HIV from their mothers each year. These infant HIV infections can be prevented by identifying and treating mothers having HIV. In addition, nearly 20% of pregnant women in developing countries are infected with syphilis, leading to more than 500,000 infant stillbirths and deaths each year. Nearly 10,000 women and 200,000 infants die each year from malaria during pregnancy, and nearly 45% of pregnant women in developing countries suffer from anemia as a result of, for example, worm infections, parasites, and/or nutritional deficiencies. Anemia can adversely affect a pregnant woman's chance of surviving post-partum hemorrhage and stunt infant development. About 115,000 maternal deaths and 500,000 infant deaths have been associated with anemia in developing countries.

SUMMARY

This document provides devices and methods for metering fluids. Assays on small amounts of sample can require precise metering of small volumes of sample and required reagents. Additionally, some assays rely upon the exclusion of air from an assay chamber. In some cases, the devices and methods provided herein can deliver a precise volume of one or more fluids. In some cases, the devices and methods provided herein can deliver multiple fluids to a common channel without the presence of air bubbles along the interface between fluids.

A device for metering fluids provided herein, in some cases, includes a metering channel being defined between a metering inlet and a metering outlet, a loading channel having a loading inlet and intersecting the metering channel at a loading-metering intersection point, and an outflow channel having an outflow outlet and intersecting the metering channel at a metering-outflow intersection point. The metering channel can define a volume of fluid to be metered between the metering-outflow intersection point and the loading-metering intersection point. The inlets and outlets of the devices and systems provided herein can, in some cases, include valves to control the flow of fluids into and out of said devices. In some cases, the metering-outflow intersection point and/or the loading-metering intersection point can include a capillary-stop geometry to restrict fluid from heading down particular paths (e.g., when fluid is flowing due to capillary action).

A device for metering fluids provided herein, in some cases, includes a plurality of metering channels each having a metering inlet and each intersecting at least one of the other metering channels at one or more metering-metering intersection points, an outflow channel having an outflow outlet and intersecting a first of said plurality of metering channel at a metering-outflow intersection point, and a loading channel having a loading inlet and intersecting a second of said plurality of metering channel at a loading-metering intersection point. Each metering channel can define a volume of fluid to be metered between the two of the intersection points. The inlets and outlets of the devices and systems provided herein can, in some cases, include valves to control the flow of fluids into and out of said devices. The metering-outflow intersection point, the loading-metering intersection point, and/or the one or more metering-metering intersection points can each have a capillary-stop geometries, which can restrict fluid from heading down particular paths (e.g., when fluid is flowing due to capillary action).

A method for metering fluids provided herein, in some cases, includes delivering fluids in sequence to fill the metering channel with a metered fluid and a loading channel with a loading fluid followed by pushing the fluids out of the channels.

In some cases, filling the metering channel can include opening a metering inlet valve and a metering outlet valve, closing the other valves, and pumping or pulling the metered fluid into the metering channel. For example, by having the other valves closed, pressure within other channels can prevent the metered fluid from flowing into the other channels. In some cases, filling the metering channel can include delivering a metered fluid to a metering inlet such that the metered fluid is wicked by capillary action through the metering channel. For example, the metering channel can be a microfluidic channel having a hydrophilic surface. In some cases, intersection points and/or the metering outlet can have capillary-stop geometries such that wicked fluid is not wicked into other channels or past the metering outlet. In some cases, a combination of valves, capillary-stop geometries, pumping, and wicking can be used to fill the metering channel without a substantial volume of metered fluid being delivered into intersecting channels provided herein.

In some cases, filling the loading channel can include opening the loading inlet valve and one of the outlet valves (e.g., a loading outlet valve), closing the other valves, and pumping or pulling the loading fluid into the loading channel. For example, by having the other valves closed, pressure within other channels can prevent the loading fluid from flowing into an intersecting metering channel. In some cases, filling the loading channel can include delivering a loading fluid to a loading inlet such that the loading fluid is wicked by capillary action through the loading channel. For example, the loading channel can be a microfluidic channel having a hydrophilic surface. In some cases, a loading-metering intersection point and/or a loading outlet can have capillary-stop geometries such that wicked fluid is not wicked into an intersecting metering channel or past the loading outlet. In some cases, a combination of valves, capillary-stop geometries, pumping, and wicking can be used to fill the loading channel without a substantial volume of loading fluid being delivered into an intersecting metering channel.

The metering channel and the loading channel can be filled in either order. Excess fluids can exit the metering outlet or the loading outlet. Although the metered and loading fluids form an interface at the loading-metering intersection point, the microfluidic geometry at the loading-metering intersection point can limit mixing of the fluids at the loading-metering intersection point. The fluids can be pushed out of the arrangement by closing a metering inlet and a metering outlet, and delivering fluid through the loading inlet to push loading fluid through the loading-metering intersection point to push metered fluid through the metering-outflow intersection point, through the outflow channel, and thus through the outflow outlet. For example, a fluid (e.g., additional loading fluid) can be pumped through the loading inlet valve. The volume of the metered fluid delivered through the outflow outlet valve is defined by the geometry of the metering channel between the loading-metering intersection point and the metering-outflow intersection point.

In some cases, the loading channel does not include a loading outlet. In cases where the loading channel does not include a loading outlet, the loading channel can be filled with the loading fluid prior to filling the metering channel with the metered fluid. In cases where the loading channel does not include a loading outlet, the metering outlet or an outflow outlet can be opened and loading fluid pumped or pulled into the loading channel until excess loading fluid passes through the loading-metering intersection point into the metering channel. Excess loading fluid in the metering channel can be removed from the metering channel when the metering channel is filled with metered fluid, which would push excess loading fluid out of the metering outlet.

In some cases, a method of metering fluids provided herein includes metering multiple fluids. In some cases, a diagnostic device provided herein can require a precise metering of a biological sample (e.g., blood) and precise metering of a reagent. For example, an assay may require a precise metering of one or more staining reagents and/or a washing reagent. A method of metering multiple fluids can include filling multiple metering channels with different metered fluids, each metering channel having a metering inlet and intersecting at least one of the other metering channels, filling a loading channel with a loading fluid, the loading channel intersecting a first metering channel at a loading-metering intersection point, and delivering metered amounts of different metered fluids in succession through an outflow channel that intersects a second metering channel at a metering-outflow intersection point by delivering a fluid (e.g., additional loading fluid) through the loading inlet.

The methods and devices provided herein can provide a reliable and inexpensive method to meter small amounts of fluid precisely. The methods and devices provided herein also can provide a train of metered fluids in a single channel. In some cases, interfaces between fluids in a train of fluids can be substantially free of air bubbles. For example, in some cases, diagnostic assays can require the introduction of sample and/or reagent into an assay chamber without the presence of air. Air bubbles can lodge in a channel and alter flow patterns, trap fluids behind them, strip captured cells off the walls of a channel, interfere with imaging if the assay relies in it, or a combination thereof. Devices and systems provided herein can manage air bubbles in one or more of the channels included therein by having geometries that have high surface tension and by ensuring laminar in the channels, such that bubbles stick together and follow the flow past intersections.

The details of one or more embodiments are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figures 1A, 1B, 1C, 1D:
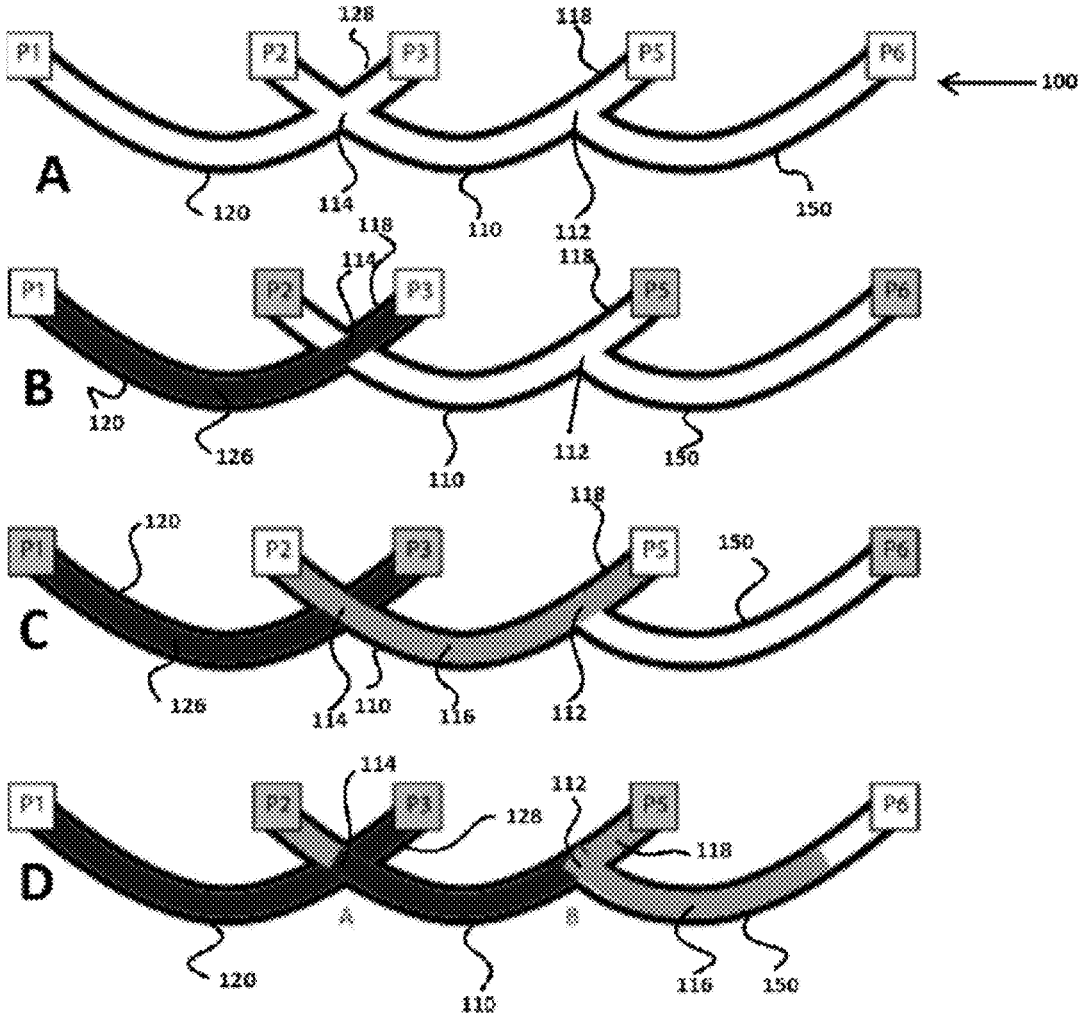
FIGS. 1A-1D depict a first example of an arrangement of microfluidic channels and illustrate how that arrangement can be used to precisely meter a predetermined amount of a metered fluid.

This document provides methods and devices related to metering precise amounts of fluid. In some cases, the methods and devices provided herein relate to diagnosing one or more disease conditions (e.g., HIV infections, syphilis infections, malaria infections, anemia, gestational diabetes, and/or pre-eclampsia). As described herein, a biological sample can be collected from a mammal (e.g., pregnant woman) and analyzed using a kit including a metering device provided herein to determine whether or not the mammal has any of a group of different disease conditions. In the case of a device that diagnoses multiple disease conditions, the analysis for each disease condition can be performed in parallel such that the results for each condition are provided at essentially the same time. In some cases, the methods and devices provided herein can be used outside a clinical laboratory setting. For example, the methods and devices provided herein can be used in rural settings outside of a hospital or clinic. Any appropriate mammal can be tested using the methods and materials provided herein. For example, dogs, cats, horses, cows, pigs, monkeys, and humans can be tested using a diagnostic device or kit provided herein.

The methods and devices provided herein can provide precise metering of small volumes of blood and/or reagents for tests that determine whether or not the mammal has one or more disease conditions. In some cases, methods and devices provided herein can repeatedly deliver a predetermined volume of fluid with a deviation of not more than 5% (e.g., not more than 4%, not more than 3%, not more than 2%, not more than 1%, or not more than 0.5% deviation). The deviation of a device or method provided herein can be assessed by metering ten consecutive volumes of fluid including a reporter molecule (e.g., a fluorescent additive or radiolabel such as tritium), using a signal from the reporter molecule to determine an average volume of each metered fluid (e.g., using a plate-reader), and determining the maximum deviation from that average volume and dividing that maximum deviation by the average volume to determine the deviation. In some cases, an average volume of metered fluid can be determined using Karl Fisher analysis. In some cases, methods and devices provided herein can be arranged to meter a predetermined volume of fluid of 500 μL or less (e.g., 250 μL or less, 100 μL or less, 75 μL or less, 50 μL or less, 25 μL or less, 10 μL or less, or 5 μL or less). In some cases, methods and devices provided herein can be arranged to meter a predetermined volume of fluid of between 0.5 μL and 500 μL with a maximum plus or minus deviation of 5%, a predetermined volume of fluid of between 1 μL and 250 μL with a maximum plus or minus deviation of 4%, a predetermined volume of fluid of between 2 μL and 100 μL with a maximum plus or minus deviation of 3%, a predetermined volume of fluid of between 5 μL and 50 μL with a maximum plus or minus deviation of 2%, or a predetermined volume of fluid of between 8 μL and 20 μL with a maximum plus or minus deviation of 1%.

In some cases, the methods and devices provided herein can deliver multiple fluids through a common channel (e.g., an outflow channel) in sequence. In some cases, multiple fluids delivered sequentially through a common channel can be precisely metered. In some cases, methods and devices provided herein can meter one or more fluids through a common channel without creating air bubbles at the interface of the one or more metered fluids and fluids coming thereafter. For example, methods and devices provided herein can deliver blood and one or more reagents sequentially through a common channel towards an assay chamber without air bubbles being introduced into the common channel. In some cases, air bubbles can lodge in the channels and alter flow patterns, trap fluids behind them that then can't be washed out, strip captured cells off the walls of a channel, interfere with imaging if the assay relies in it, or a combination thereof. In some cases, a devices and systems provided herein include geometries that promote laminar flow such that bubbles tend to stick together and flow past intersections.

Methods and devices provided herein can use a geometry of an arrangement of channels to meter the volume of one or more fluids, which can be achieved without a need to form a vacuum. In some cases, methods and devices provided herein can provide a train of fluids without forming air bubbles between each fluid. In some cases, methods and devices provided herein can precisely meter fluids without relying on the precision of pumps.

FIGS. 1A-1D illustrates one basic approach. FIG. 1A depicts a first example of an arrangement 100 of microfluidic channels prior to introduction of fluid. The arrangement includes a metering channel 110 having a metering inlet P2 and a metering outlet P5. Metering channel 110 intersects a loading channel 120 and an outflow channel 150. Outflow channel 150 and metering channel 110 intersect at a metering-outflow intersection point 112. The portion of the metering channel 110 between the metering-outflow intersection point 112 and the metering outlet P5 forms a metering waste channel 118. Loading channel 120 and metering channel 110 intersect at a loading-metering intersection point 114. The portion of metering channel 110 between the metering-outflow intersection point 112 and the loading-metering intersection point 114 defines the metering portion of a metering channel 110. Accordingly, the geometry of metering channel 110 between metering-outflow intersection point 112 and loading-metering intersection point 114 determines the volume of the fluid metered. As shown, loading channel 120 can include a loading inlet P1, a loading waste channel 128, and a loading outlet P3. Outflow channel 150 can include an outflow outlet P6.

Each of inlets and outlets P1, P2, P3, P5, and P6 can include a valve, which can be used to control the flow of fluid past each inlet or outlet. In some cases, valves at inlets and outlets P1, P2, P3, P5, and P6 can be opened and closed to control the flow of fluids therethrough. In some cases, capillary-stop geometry can be used at inlets and outlets P1, P2, P3, P5, and P6 to prevent the flow of fluid past the inlet or outlet due to wicking of the fluid, but allow for the fluid to be pumped there through. In each arrangement provided herein, each inlet or outlet can include a valve, capillary-stop geometry, or a combination thereof to control the flow of fluid there through.

In some cases, arrangement 100 can include air prior to the introduction of fluids. Fluids can push the air out as they fill the channels. In some cases, ambient air can be evacuated prior to the introduction of fluids. In some cases, an inert gas (e.g. Nitrogen, Argon) can be within the arrangement 100 prior to the introduction of fluids.

FIG. 1B depicts a first step where loading inlet P1 and loading outlet P3 permit for fluid flow there through and inlets and outlets P2, P5, and P6 restrict the flow of fluid, as indicated by the shading in FIG. 1B. A loading fluid 126 is introduced through loading inlet P1 to fill loading channel 120 with loading fluid 126. Excess amounts of loading fluid 126 exit loading channel 120 through loading outlet P3, thus the specific volume of the loading fluid 126 introduced into the loading channel 120 does not matter as long as it is sufficient to fill the volume of the loading channel 120. Microfluidic geometry of loading channel 120 and metering channel 110 at loading-metering intersection point 114 can limit the flow of loading fluid 126 into metering channel 110.

FIG. 1C depicts a second step where metering inlet P2 and metering outlet P5 permit for fluid flow there through and inlets and outlets P1, P3, and P6 restrict the flow of fluid, as indicated by the shading in FIG. 1C. A metered fluid 116 is introduced through the metering inlet P2 to fill metering channel 110 with metered fluid 116. Excess amounts of metered fluid 116 exit metering channel 110 through metering outlet P5, thus the specific volume of metered fluid 116 introduced into the metering channel 110 does not matter as long as it is sufficient to fill the volume of the metering channel 110. Microfluidic geometry of channels 110, 120, and 150 at metering-outflow intersection point 112 and loading-metering intersection point 114, optionally along with the closing of valves at inlets and outlets P1, P3, and P6 or the use of capillary-stop geometries, can limit the flow of the metered fluid 116 into loading channel 120 or outflow channel 150. In some cases, the order of introduction of metered fluid 116 and loading fluid 126 into metering channel 110 and loading channel 120 can be reversed. The successive introduction of the metered fluid 116 into the metering channel 110 and loading fluid 126 into the loading channel 120 can create a bubble free interface between the two fluids at the loading-metering intersection point.

FIG. 1D depicts a third step where loading inlet P1 and outlet P6 permit for fluid flow there through and inlets and outlets P2, P3, and P5 restrict the flow of fluid, as indicated by the shading in FIG. 1D. An additional amount of loading fluid 126 can be introduced through the loading inlet P1 to push loading fluid 126 in loading channel 120 into metering channel 110 at loading-metering intersection point 114, which thus pushes metered fluid 116 in metering channel 110, between the two intersection points 112 and 114, into outflow channel 150 at metering-outflow intersection point 112, and out of the outflow outlet P6. The volume of the metered fluid 116 pushed into the outflow channel 150 and through outflow outlet P6 is dictated by the geometry between the two intersection points 112 and 114. In some cases, the fluid introduced into loading channel 120 and used to thus push the fluids into the outflow channel 150 can be a different fluid than the loading fluid.

Figures 2A, 2B, 2C, 2D:
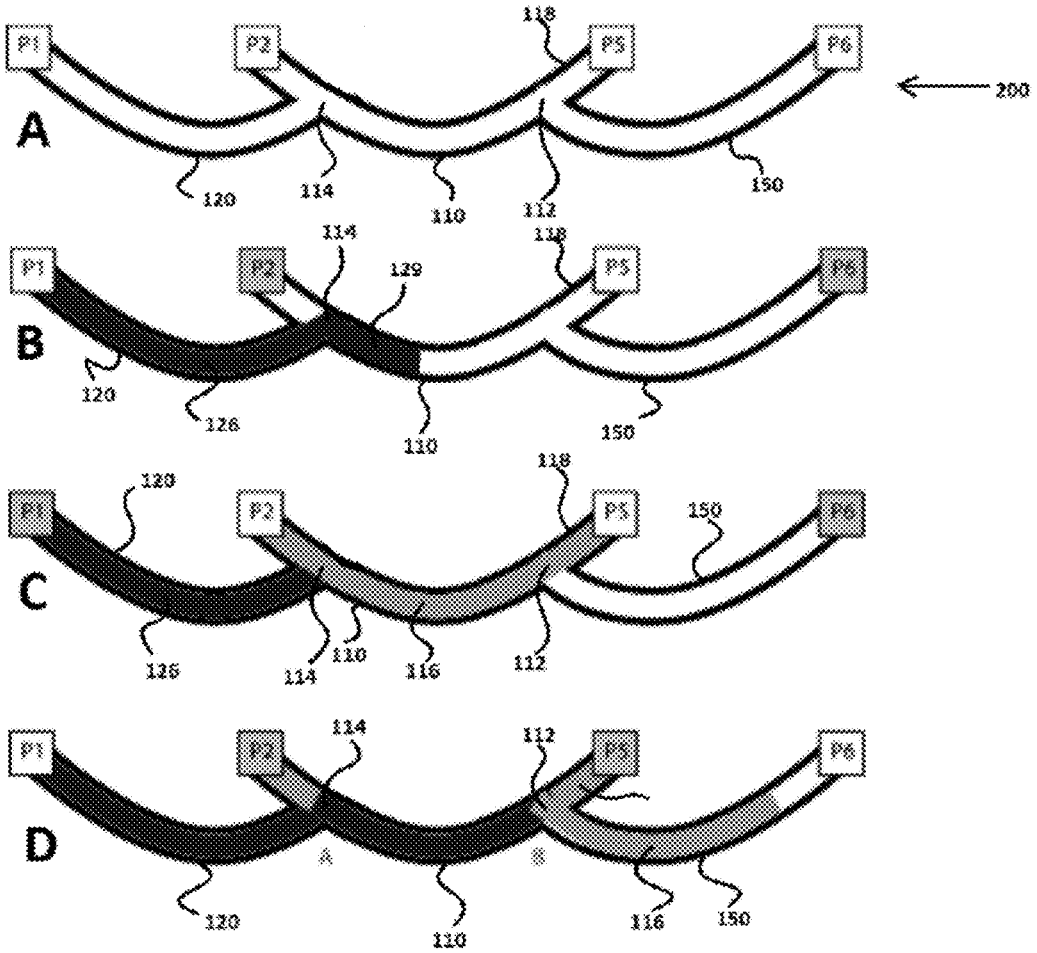
FIGS. 2A-2D depict a second example of an arrangement of microfluidic channels and illustrate how that arrangement can be used to precisely meter a predetermined amount of a metered fluid.

In some cases, the loading channel can intersect the metering channel, but not have a loading outlet. FIGS. 2A-2D depict a second example of an arrangement 200 of microfluidic channels where the arrangement 200 differs from the arrangement 100 depicted in FIGS. 1A-1D due to the arrangement 200 lacking a loading outlet P3. In the first step depicted in FIG. 2B, when loading fluid 126 is introduced into loading channel 120, excess amounts 129 of loading fluid 126 travel into metering channel 110 at the loading-metering intersection point 114. As shown in FIG. 2B with the shading, the loading inlet P1 and the metering outlet P5 can permit the flow of fluid there through and the metering inlet P2 and the outflow outlet P6 restrict the flow of fluid therethrough during the filling of loading channel 120 with loading fluid 126. Excess loading fluid 129 in the metering channel 110 can then be pushed out of metering channel 110 through metering outlet P5 when metering channel 110 is filled with metered fluid 116 in a second step, as illustrated in FIG. 2C. Excess amounts of metered fluid 116 also exit metering outlet P5. The capillary-stop geometry at two intersection points 112 and 114 and the closing of loading inlet P1 and the outflow outlet P6 during the filling of metering channel 110 limits the flow of fluid into loading channel 120 or outflow channel 150. In a third step illustrated in FIG. 2D, an additional amount of loading fluid 126 (or a different fluid) is introduced into loading channel 120 to push loading fluid 126 into metering channel 110, which pushes a predetermined volume of metered fluid 116 in the metering channel 110 between the two interaction points 112 and 114 into outflow channel 150 at the metering-outflow intersection point 112.

Figure 3:
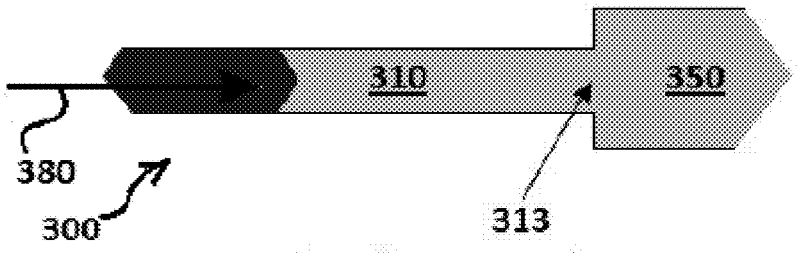
FIG. 3 depicts an example of a capillary stop.

As discussed above, the flow of fluid through inlets and outlets P1, P2, P3, P5, and P6 can be controlled using valves and/or capillary stop geometries. An example of a capillary stop is shown in FIG. 3. A flow fo fluid 380 can advance down a channel 310 by capillary action (e.g., wicking). A capillary stop 313 can be formed by having sharp angles at a widening point 350, which will stop the flow of fluid past the capillary stop 313 by capillary action. Fluid flow past the widening point 350 can be achieved by supplying pressure to the system 300 to pump the fluid flow 380 past the capillary stop 313. In this way, a capillary stop 313 can act similar to a valve in a device, system, or method provided herein.

Figures 4A, 4B, 4C:
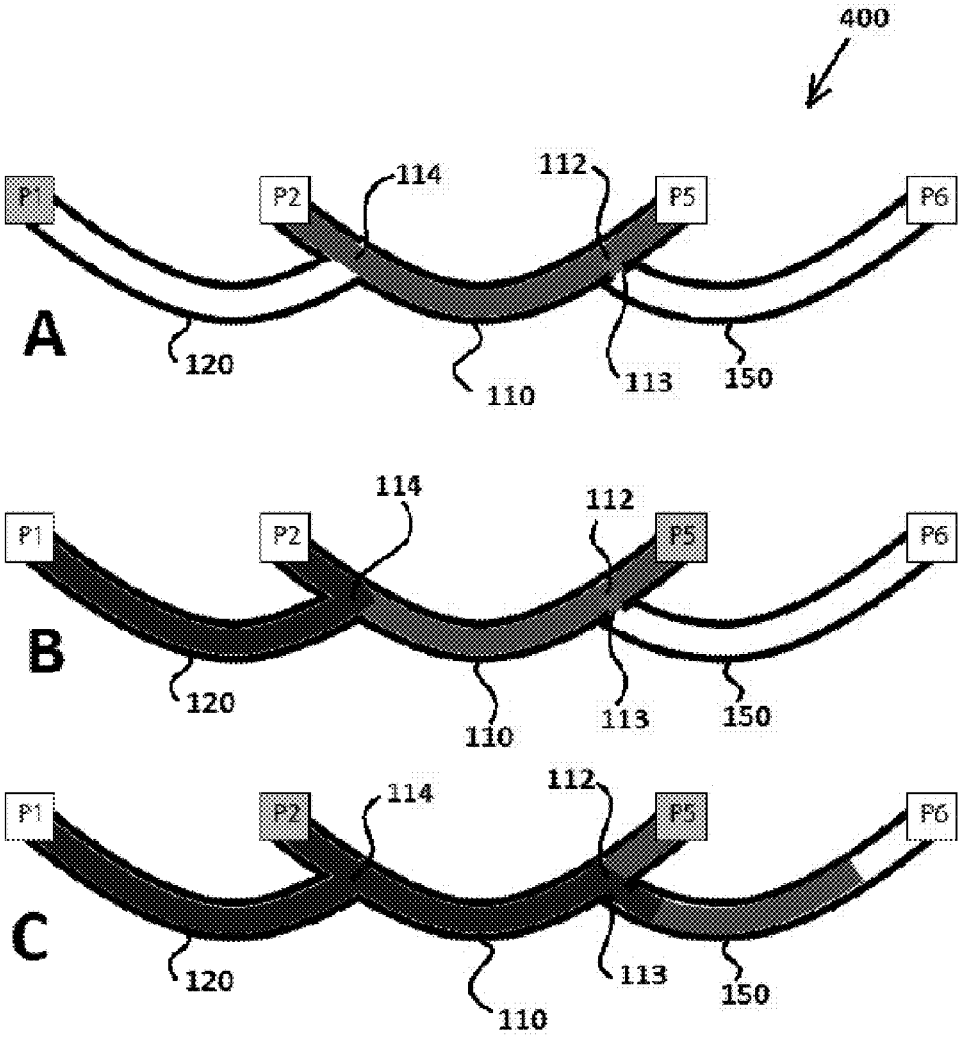
FIGS. 4A-4C depict a third example of an arrangement of microfluidic channels and illustrate how that arrangement can be used to precisely meter a predetermined amount of a metered fluid.

FIGS. 4A-4C depict another arrangement 400 and method for metering a fluid. As shown in FIGS. 4A-4C, the system can include capillary stop geometry 113 at an intersection metering-outflow intersection point 112. As shown in FIG. 4A, a metered fluid can enter metering inlet P5 and flow via capillary action towards metering outlet P2. A valve at loading inlet P1 can be closed, as indicated by the shading, which can inhibit a flow of metering fluid into loading channel 120. A capillary stop 113 at the metering-outflow intersection point 112 can inhibit metering fluid from entering outflow channel 150 despite outflow outlet P6 remaining open. As shown in FIG. 4B, a loading fluid can enter loading inlet P1 and flow through metering outlet P2. Loading channel 120 can also be filled via capillary action. A valve at metering inlet P5 can be closed to inhibit a flow of loading fluid through the metering channel 110 towards metering inlet P5. Capillary stop 113 can provide a hold strong enough to prevent the metering fluid from being pushed into outflow channel 150. A metered amount of metered fluid in the metering channel between a loading-metering intersection point 114 and a metering-outflow intersection point 112 can then be pumped past capillary stop 113 by closing a valve at metering inlet P5 and a valve at metering outlet P2 and pumping addition loading fluid through loading inlet P1. Pressure from the pumping of loading fluid into the loading inlet P1 can overcome the capillary stop and allow metering fluid to enter outflow channel 150.

In some cases, devices provided herein include diagnostic devices and kits, which can employ the methods provided herein. In some cases, the devices and kits provided herein can be microfluidic diagnostic devices and/or kits. In some cases, the outflow outlet valve leads into a microfluidic assay chamber. For example, referring back to FIGS. 1A-1D, arrangement 100 can, in some cases, be used to deliver a metered quantity of a biological sample (e.g., blood) and a reagent (e.g., a lysing reagent) to a microfluidic assay chamber.

Figure 5:
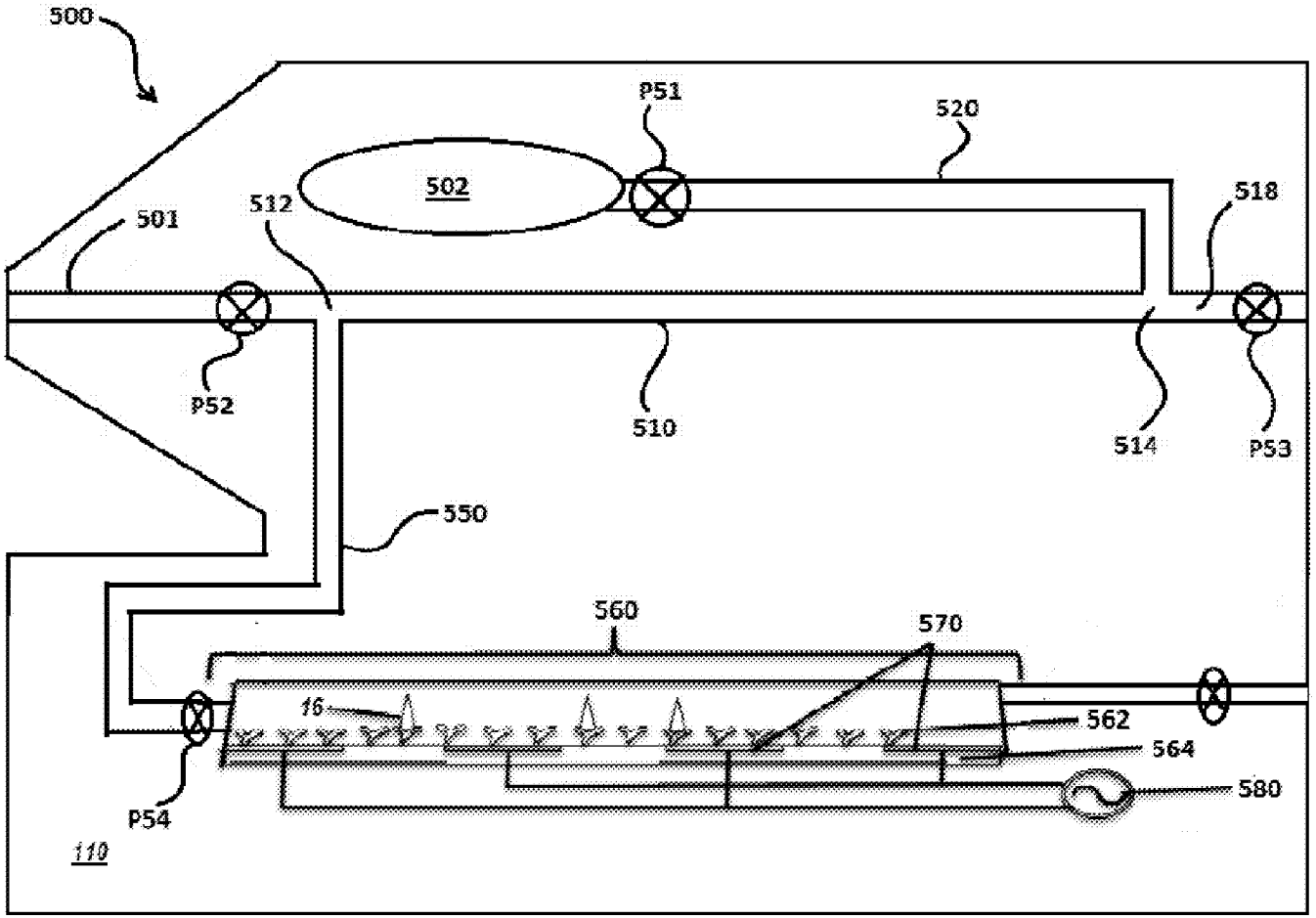
FIG. 5 depict an example of an assay card used to meter blood and reagent into an assay chamber.

FIG. 5 also depicts an arrangement of channels as part of a microfluidic diagnostic device 500, have an inlet 501 for receiving biological sample and a reservoir 502 for holding a reagent. For example, the microfluidic diagnostic device 500 can be designed to determine a $CD4^+$ count for a subject, the biological sample can be blood including $CD4^+$ cells, and the reagent can be a lysing reagent. A biological sample metering channel 510 can include a metering inlet P52 and a metering outlet P53, which can both include valves. A reagent loading channel 520 having a loading inlet P51 can intersect biological sample metering channel 510 at a loading-metering intersection point 514. An outflow channel 550 having an outflow outlet P54 can intersect biological sample metering channel 510 at a metering-outflow intersection point 512. Outflow channel 550 leads to a microfluidic assay chamber 560, which includes capture molecules 562 supported on a substrate 564 and electrodes 570, which form part of a testing circuit 580. Microfluidic assay chamber 560 can also include a plurality of microfluidic components such as reactors, pumps, check valves, reservoirs, channels, sensors, and heaters to enable diagnostic device to detect medical conditions from a biological sample.

In use, blood can be delivered through valve P52 to fill biological sample metering channel 510 by opening valves at P52 and P53, closing a valve at P51, and using capillary action to allow the blood to flow into biological sample metering channel 510. Excess blood can flow through waste channel 518 and past valve P53. A capillary stop at the metering-outflow intersection point 512 can resist a flow of blood into outflow channel 550. Lysing reagent can be delivered from reservoir 502 through a valve at loading inlet P51 to fill reagent loading channel 520 by opening valves at P51 and P53, closing valves P52, and using a capillary action to allow the lysing reagent to flow into reagent loading channel 520. Excess lysing reagent can flow through waste channel 518 and past valve P53. The blood and the lysing reagent can form a bubble free interface at loading-metering intersection point 514. Because the blood in biological sample metering channel 510 and the lysing reagent in reagent loading channel 520 do not appreciably mix, the lysing reagent does not lyse the CD4+ cells in the blood. The filling of reagent loading channel 520 with lysing reagent and the filling of metering channel 510 with blood can occur in any desired order. In some cases, a microfluidic diagnostic device can provide a measured amount of a biological sample, followed by a binding solution, followed by a wash solution, followed by a measured lysing reagent.

After filling biological sample metering channel 510 with blood and reagent loading channel 520 with lysing reagent, a train of blood and lysing reagent can be delivered to microfluidic assay chamber 560 by opening valves P51 and P54, closing valves P52 and P53, and using a force (e.g., a pump) to deliver additional lysing reagent from reagent reservoir 502 past valve P51. In some case, an external device, including a controller, can receive the microfluidic diagnostic device 500 and apply pressure to reagent reservoir 502 to push lysing reagent into the reagent loading channel 520. Capture molecules 562 on substrate 564 can be adapted to capture $CD4^+$ cells 16. Blood, with $CD4^+$ cells 16 left behind, thus moves out of the microfluidic assay chamber 560. Lysing reagent follows the blood into microfluidic assay chamber 560 to lyse the $CD4^+$ cells 16 left behind in microfluidic assay chamber 560. A bubble free interface between the lysing reagent and the blood, however, can eliminate the opportunity for air bubbles to form around captured $CD4^+$ cells in microfluidic assay chamber 560, which might prevent the lysing of those cells within the assay chamber. As the $CD4^+$ cells are lysed, circuit 580 and electrodes 570 within microfluidic assay chamber 560 can be used to determine a change in current, impedance, or conductance in microfluidic assay chamber 560, which can be used to determine a number of $CD4^+$ cells in the sample. Precise metering of the blood can allow for a precise number of cells being metered into the microfluidic assay chamber, thus a precise $CD4^+$ count for a subject can be calculated from detected changes in current, impedance, or conductance.

Any number of fluids (e.g., samples and/or reagents) can be metered and combined using the mechanisms described in FIGS. 1A-1D, FIGS. 2A-2D, and FIGS. 4A-4C. FIGS. 6A-6F depict an exemplary arrangement that combines three different fluids. FIGS. 6A-6F depict an arrangement 600 including a first metering channel 610, a second metering channel 620, a loading channel 630, and an outflow channel 650. First metering channel 610 intersects the outflow channel 650 at a metering-outflow intersection point 612 and intersects second metering channel 620 at a metering-metering intersection point 614. Second metering channel 620 intersects loading channel 630 at a loading-metering intersection point 622. Intersection points 612, 614, and 622 can each have capillary-stop geometry that guides fluids on the desired path. First metering channel 610 can include a first metering inlet P4, a first metering waste channel 618, and a first metering outlet P7. Second metering channel 620 can include a second metering inlet P2, a second metering waste channel 628, and a second metering outlet P5. Loading channel 630 can include a loading inlet P1, a loading waste channel 638, and a loading outlet P3.

Figures 6A, 6B, 6C, 6D, 6E, 6F:
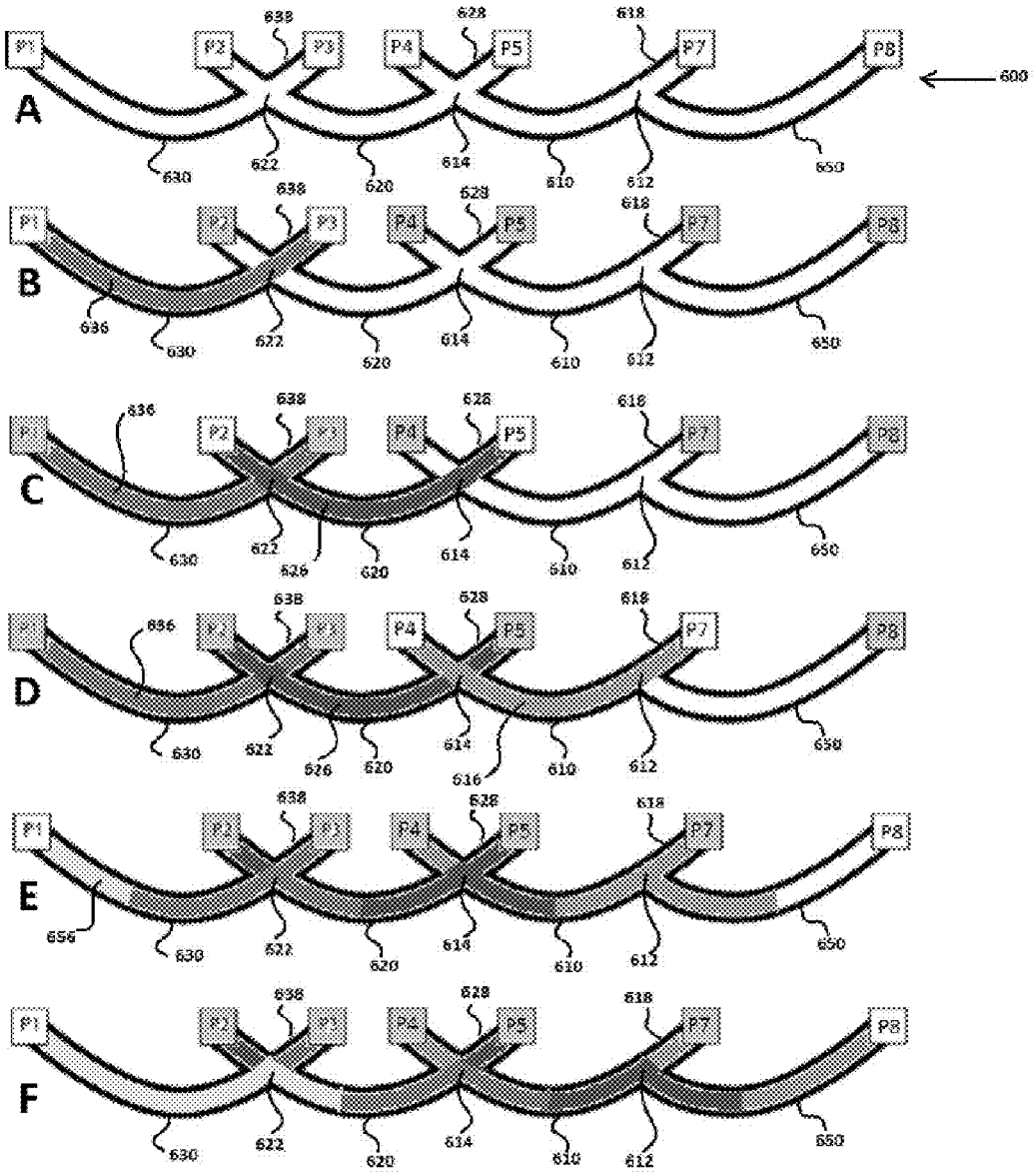
FIGS. 6A-6F depict a fourth example of an arrangement of microfluidic channels and illustrate how that arrangement can be used to precisely meter a predetermined amount of a first metered fluid and a second metered fluid.

In a first step, as shown in FIG. 6B, valves at loading inlet P1 and loading outlet P3 are open while the other valves at P2, P4, P5, P7, and P8 are closed and a loading fluid 636 is pumped into loading channel 630. In a second step, as shown in FIG. 6C, valves at a second metering inlet P2 and second metering outlet P5 are open while the other valves at P1, P3, P4, P7, and P8 are closed and a second metered fluid 326 is pumped into second metering channel 620. In a third step, as shown in FIG. 3D, valves at first metering inlet P4 and first metering outlet P7 are open while the other valves at P1, P2, P3, P5, and P8 are closed and a first metered fluid 616 is pumped into first metering channel 610. The filling of first metering channel 610, second metering channel 620, and loading channel 630 can occur in any order. For example, the filling of the metering channel can occur first, followed by the filling of second metering channel 620, followed by the filling of loading channel 630.

Once channels 610, 620, and 630 are filled fluids 616, 626, and 636, respectively, each fluid can form a bubble free interface with an adjacent fluid at intersection points 614 and 622. First and second metered fluids can then be delivered in a predetermined volume through the outflow channel by opening the loading inlet P1 and the outflow outlet P8 and closing the other valves P2, P3, P4, P5, and P7. An additional fluid 656 can be pumped through the loading inlet P1 to push first metered fluid 616, followed by second metered fluid 626, followed by loading fluid 636 into the outflow channel 650 and through the outflow outlet P8. The volume of first metered fluid 616 passed into outflow channel 650 is determined by the geometry of first metering channel 610 between metering-outflow intersection point 612 and metering-metering intersection point 614. The volume of second metered fluid 626 passed into outflow channel 650 is determined by the geometry of second metering channel 620 between metering-metering intersection point 614 and loading-metering intersection point 622. In some cases, the volume of loading fluid 636 passed into the outflow channel 650 is determined by the geometry of loading channel 630 between loading inlet P1 and loading-metering intersection point 622. In some cases, fluid flow through arrangement 600 can be controlled by one or more capillary stops at one or more of the inlets, outlets, or intersection points. In some case, the additional fluid 656 used to push the fluids through the arrangement 600 can be the same as loading fluid 636. In some case, additional fluid 656 used to push the fluids through the arrangement can be an inert fluid.

A number of embodiments of the invention have been described. Nevertheless, it will be understood that various modifications may be made without departing from the spirit and scope of the invention. Accordingly, other embodiments are within the scope of the following claims.

What is claimed is:

1. A method for metering of fluids, comprising:

introducing a fluid into a metering channel, the metering channel being defined between a metering inlet and a metering outlet, the metering channel intersecting an outflow channel at a metering-outflow intersection point and a loading channel at a loading-metering intersection point, wherein a portion of the metering channel between the metering-outflow intersection point and the loading-metering intersection point defines a metering portion having a predetermined volume; and introducing fluid into the loading channel through a loading inlet valve to push a loading fluid in the loading channel into the metering channel at the loading-metering intersection point and push the fluid in the metering portion into the outflow channel; and metering a first predetermined volume of the fluid through said outflow channel using a controller, wherein the metering comprises:

delivering a volume of a loading fluid through the loading channel to fill the loading channel with the loading fluid, with excess volume of the loading fluid moving past the loading-metering intersection point and into a portion of the metering channel and/or into a loading waste channel having a loading outlet;

delivering a volume of the fluid through the metering channel to fill the metering channel with the fluid, the prior contents of the metering channel and excess volume of the fluid being pushed out of the metering channel through the metering outlet; and delivering fluid through the loading inlet to push the loading fluid in the loading channel into the metering channel at the loading-metering intersection point and thus push the fluid in the metering channel between the metering-outflow intersection point and the loading-metering intersection point into the outflow channel.

2. The method of claim 1, wherein said metering inlet comprises a valve.

3. The method of claim 1, wherein said metering outlet comprises a valve.

4. The method of claim 1, wherein said metering-outflow intersection point, the loading-metering intersection point, or both the metering-outflow and loading-metering intersection points comprise capillary-stop geometry.

5. The method of claim 1, wherein the metering-outflow intersection point comprises capillary-stop geometry.

6. The method of claim 1, wherein the metering inlet comprises a valve, the metering outlet comprises a valve, the loading channel comprises a valve, and the metering-outflow intersection point comprises capillary-stop geometry.

7. The method of claim 1, wherein a loading waste channel is defined between the loading-metering intersection point and a loading outlet valve.

8. The method of claim 1, wherein the metering channel, the loading channel, and the outflow channel are microfluidic channels.

9. The method of claim 1, wherein the metering channel, the loading channel, and the outflow channel each have a maximum height of between 1 micron and 1000 microns.

10. The method of claim 1, wherein a microfluidic assay chamber is in fluid communication with the outflow channel.

11. A method for metering a biological sample in a microfluidic diagnostic device, comprising:

introducing a biological sample into a sample inlet and into a biological sample metering channel, the biological sample metering channel being defined between the sample inlet valve and a waste outlet valve, the biological sample metering channel intersecting an outflow channel at a metering-outflow intersection point and a reagent channel at a reagent-metering intersection point, wherein a portion of the biological sample metering channel between the metering-outflow intersection point and the reagent-metering intersection point defines a predetermined volume of biological sample to be delivered to a microfluidic diagnostic device;

filling the reagent channel with a reagent, wherein excess reagent passes through the reagent-metering intersection point into the biological sample metering channel and through the waste outlet valve; and closing the sample inlet and the waste outlet valve; and introducing additional reagent into the reagent channel through a reagent inlet valve to push the reagent in the reagent channel into the biological sample metering channel at the reagent-metering intersection point and push the biological sample in the biological sample metering channel between the reagent-metering intersection point and the loading-metering intersection point into the outflow channel and into a microfluidic assay chamber.

12. The method of claim 11, wherein the biological sample is blood.

13. The method of claim 11, wherein the biological sample metering channel has a maximum height of between 1 micron and 1000 microns.

14. The method of claim 11, wherein the reagent is selected from the group consisting of lysing reagents, fluorescent marker reagents, chemical reagents with and without viscosifying agents, labeling agents.

15. The method of claim 11, wherein the metering-outflow intersection point comprises a capillary-stop geometry that inhibits a flow of fluid into the outflow channel.

16. A method for metering of fluids, comprising:

introducing a fluid into a metering channel, the metering channel being defined between a metering inlet and a metering outlet, the metering channel intersecting an outflow channel at a metering-outflow intersection point and a loading channel at a loading-metering intersection point, wherein a portion of the metering channel between the metering-outflow intersection point and the loading-metering intersection point defines a metering portion having a predetermined volume; and introducing fluid into the loading channel through a loading inlet valve to push a loading fluid in the loading channel into the metering channel at the loading-metering intersection point and push the fluid in the metering portion into the outflow channel;

metering a plurality of fluids through said outflow channel using a controller, wherein the metering comprises:

opening the loading inlet valve and at least one outlet valve and closing other valves to allow a volume of a loading fluid to flow through the loading channel to fill the loading channel with the loading fluid, with excess volume of the loading fluid moving past the loading-metering intersection point and into a portion of one or more metering channels and/or into a loading waste channel having a loading outlet valve;

filling each metering channel with one or more fluids, wherein each metering channel is filled by open its metering inlet valve and at least one outlet valve and closing other valves and allowing a volume of a fluid to flow through each metering channel to fill each metering channel with the fluid, wherein prior contents of each metering channel and excess volume of the fluid being pushed out of the plurality of metering channels through at least one metering outlet valve; and opening the loading inlet valve and close other valves, and pumping fluid through the loading inlet valve to push the contents of each metering channel between two intersection points into the outflow channel in series followed by the loading fluid.

* * * * *